United States Patent [19]

Crane

[11] Patent Number: 4,552,617

[45] Date of Patent: Nov. 12, 1985

[54] SECURITY FEATURES IN PAPER

[75] Inventor: Timothy T. Crane, Windsor, Mass.

[73] Assignee: Crane & Co., Dalton, Mass.

[21] Appl. No.: 620,276

[22] Filed: Jun. 13, 1984

[51] Int. Cl.[4] ..... D21D 3/00; D21H 5/10

[52] U.S. Cl. ..... 162/103; 162/110; 162/134; 162/140

[58] Field of Search ..... 162/103, 105, 140, 183, 162/134, 124, 125, 110; 428/915, 916

[56] References Cited

U.S. PATENT DOCUMENTS 4,061,468 12/1977 Lange et al. ..... 162/140

4,437,935 3/1984 Crane ..... 162/140

*Primary Examiner*—Peter Chin

[57] ABSTRACT

Security features for authentification of currency paper are incorporated within the paper during the paper making process. Various codes are incorporated within the paper for viewing by means of transmitted light. In one embodiment the identifying indicia is microprinted on thin strips of a carrier material which dissolves during the dewatering and drying stage of the paper making process. The microprinted indicia remains intact and is readable by means of transmitted light yet is neither legible nor reproductible with reflected light.

9 Claims, 9 Drawing Figures

SECURITY FEATURES IN PAPER

BACKGROUND OF THE INVENTION

Methods are currently available for providing non-removable and optically readable security devices in paper during the paper making process. U.S. Pat. No. 4,437,935 discloses a method for incorporating one such security device by using a carrier paper which becomes dispersed upon contact with the wet paper stock during the paper making process. U.S. patent application (Crane-4) discloses a method of introducing a security device within the paper stock during the paper making process by employing a carrier paper to which the device is adhered. The carrier paper intermeshes with the base paper fibers forming a composite paper facilitating permanent attachment of the device. Both the aforementioned Application and Patent are incorporated herein for purposes of reference.

In both the aforementioned patent and patent application the carrier paper used to transport the security device remains an integral part of the finished paper and can be discerned from the base paper only by close examination. When it is desired to provide a micro-code integrally formed within the substance of the paper for optical reading by means of transmitted light, the carrier paper is an inappropriate substrate for fine line codes or microprint. U.S. Pat. No. 3,880,706 discribes a method for imparting security fibers manufactured from a thermoplastic material which is fused within the paper fibers during the paper making process. One such material being a thermoplastic material which becomes fused at the final stages of the paper making process by subjecting the paper to a pre-determined temperature. Once the thermoplastic material has become fused within the paper, its presence may be detected by transmitted light.

When micro-coded information is to be deployed within paper, it is first microprinted on a thin strip or transparent material such as a polyester plastic film. The polyester film is then introduced from a continuous spool to the paper stock on a Fourdrenier or a cylinder mold machine during the sheet forming process. Once the paper fibers are pressed and dried to form the finished paper, the polyester film remains intact and the microprinted material can be viewed by transmitted light. Such a film, is removable from the paper by tearing the paper to expose the film and then lifting the film from the paper as a continuous strip. The authenticity of a banknote or security document can be brought into question if part or all of the encoded thin film strip has been removed. If the micro-code contains machine-readable information for both verifying the authenticity of currency, for example, as well as identifying the denomination of the currency, this could present a serious problem. The identifying micro-code for a higher denomination currency could be reinserted.

The purpose of this invention is to provide a method for incorporating micro-coded information within security paper without leaving any indication of a carrier paper or of a carrier film.

SUMMARY OF THE INVENTION

The invention comprises the incorporation of micro-coded information on a substrate which is later dissolved during the stages of the paper making process to leave the micro-coded imformation within the paper web. The micro-cded information may be machine-read by transmitted light or detected by the emittance of unique radiation when exposed either in reflectance or transmittance to a specific source of excitation energy. This information cannot be removed from the paper without destroying both the paper and the micro-coded information. In one embodiment, the micro-coded information is provided by micro-printing on a thin strip of polyvinyl alcohol film. The polyvinyl alcohol polymer may be modified by acetylation or heat treatment to produce a film strip with specifically controlled solubility properties.

DESCRIPTION OF THE PREFERRED EMBODIMENT

Figure 1:
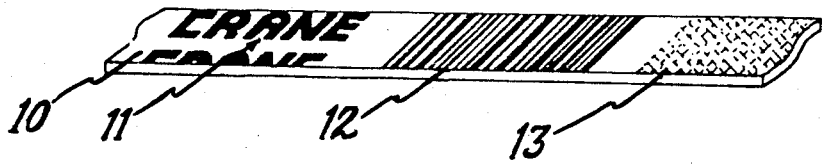
FIG. 1 is a top perspective view of the substrate micro printed with various security codes.
Figure 2:
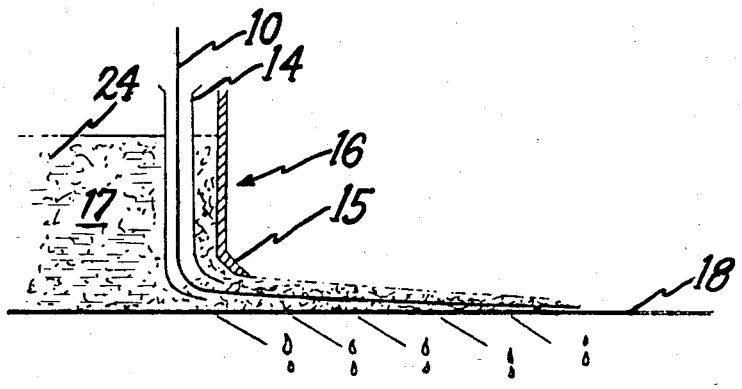
FIG. 2 is a side view in partial section of a Fourdrenier paper making machine with a funnel tube for introducing the soluble substrate strip into the paper fibers.

FIG. 1 contains a soluble carrier substrate which consists of a film or strip 10 of a polyvinyl alcohol (PVA) such as is manufactured by Meno-sol Co. of Gary, Ind. The micro-code consists of microprint indicia 11, bar graph code indicia 12 as well as phosphorescent indicia 13 which is applied by means of a micro-printing or coating process. The PVA strip 10 has a thickness of 1.5 thousandths of an inch and a width of approximately 1/32 of an inch. The PVA is treated by heating the polymer in air in order to render the polymer insoluble in water up to a temperature of 160° F. This allows the PVA strip 10 to be inserted within the slice 15 of a Fourdronier paper making machine 16 by inserting within the fiber slurry 17 through a tube 14. The slurry 17 contains a mixture of cellulosic fibers 24 which are dewatered along the Fourdrenier wire 18 to form the finished paper as best seen in FIG. 2. The slurry temperature is maintained less than 160° F. allowing the soluble PVA strip 10 to become incorporated within the nascent web which is later formed during dewatering of the fibrous slurry and then the web is pressed and dried to completely remove all the water. During the drying process the web temperature exceeds 160° F., the PVA strip dissolves and leaves the micro-code indicia intact within the web. PVA is selected as the soluble carrier substrate for the obvious reason that the PVA polymer is soluble in water and the stage at which the PVA dissolves can be controlled by the temperature usually between 100° F. and 200° F. When other water soluble materials such as gelatin, for example, are employed, the water temperature is adjusted in accordance with the preferred solubility of gelatin in water. When non-water soluble carrier substrates are used, a post processing exposure to the solvent can be made by immersing the paper in a solvent bath. Should aqueous insoluble resins be employed, the wet paper fiber containing these resin substrates can be exposed to alcohols, ketones, esters as well as specific hydrocarbons depending upon the composition of the particular resin.

Figure 3:
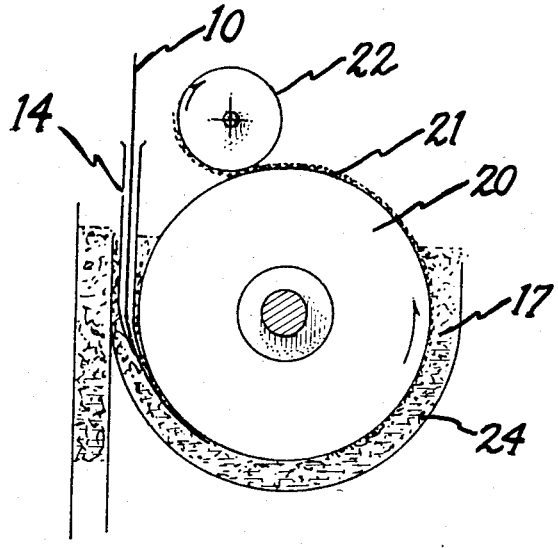
FIG. 3 is a side view in partial section of a cylinder-type paper making machine with a tube for inserting the soluble substrate film within the paper fibers.

FIG. 3 shows a cylinder machine 20 wherein the PVA strip 10 is introduced through a tube 14 inserted within the slurry 17 consisting of a plurality of mixed cellulosic fibers 24 in water. A paper cylinder mold 21 in combination with a couch roll 22 is employed for forming the fibers into the finished paper.

The method in which the microprinted indicia is retained intact within the paper web is not clearly understood at this time. One explanation being that the microprinted ink material 23, best seen in FIG. 4, being non-water soluble retains its integrity after the water soluble PVA strip 10 dissolves and migrates under capillary forces within the pores and interstices of the paper web. Other materials that have been applied to the surface of PVA strip 10 include fluorescent pigments and dyes, and metalized and metal oxide coated films. All these materials remain intact and in position upon the dissolving of the PVA strip.

Figure 4:
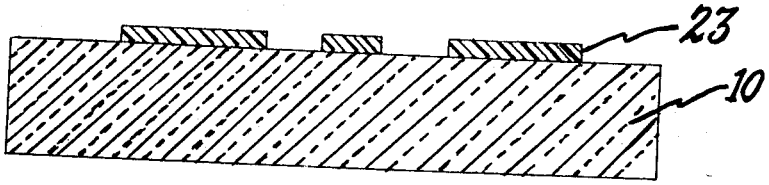
FIG. 4 is a cross section of the PVA substrate with printed indicia applied to the surface.
Figure 5:
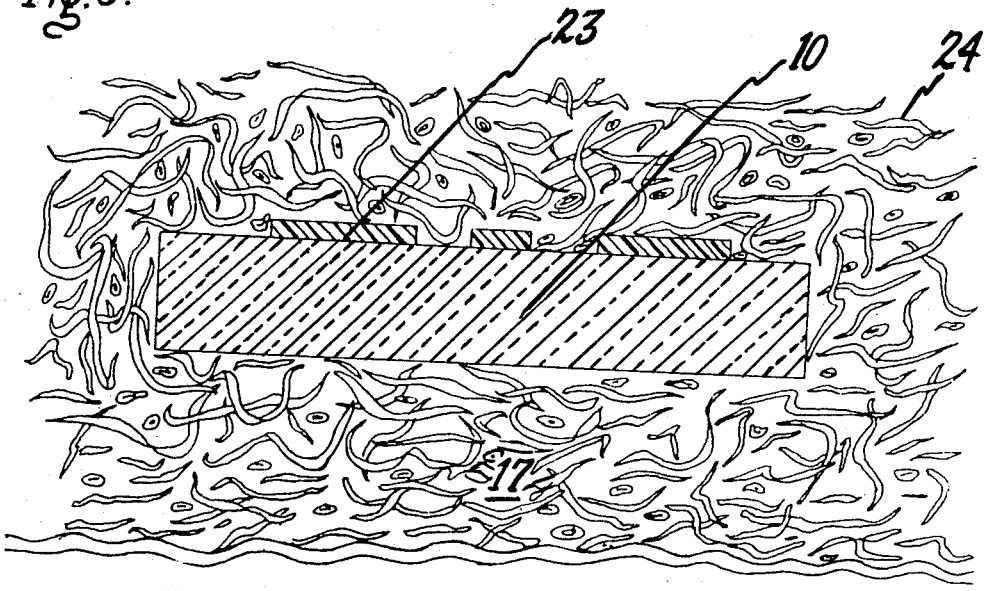
FIG. 5 is a sectional view of the PVA strip after it is formed within the wet paper web prior to dissolution.

An enlarged crossection of a portion of the strip 10 shown in FIG. 1 is depicted in FIG. 4 to show the relative thickness of the ink 23 to the strip 10.

The enlarged strip 10 is shown submerged within the slurry 17 with the individual paper fibers 24 on both sides of the strip and before the strip becomes dissolved by the water contained within the slurry.

Figure 6:
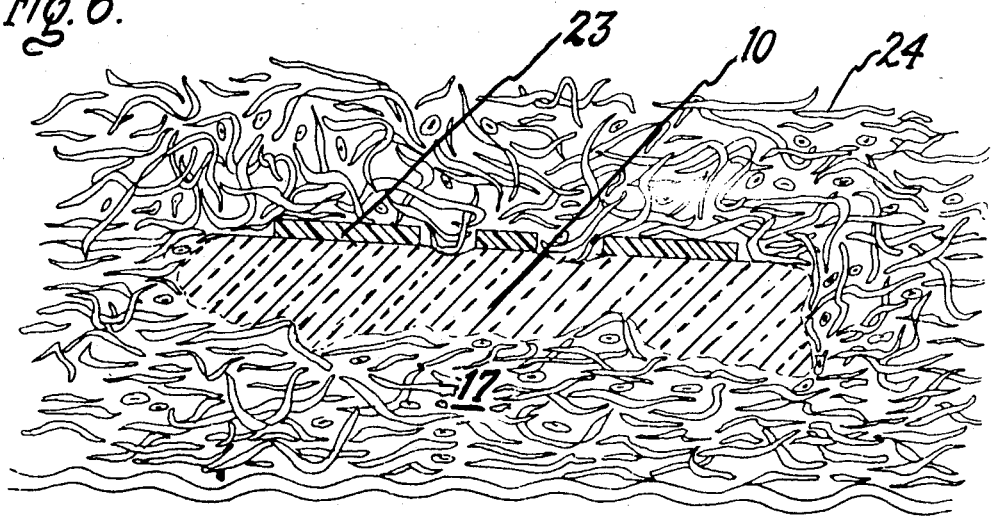
FIG. 6 is a sectional view of the PVA strip while the film is dissolving and the paper web is becoming more dense.

The partial dissolution of the strip 10 is shown in FIG. 6 with the strip material being displaced by the paper fibers during the dissolution process.

Figure 7:
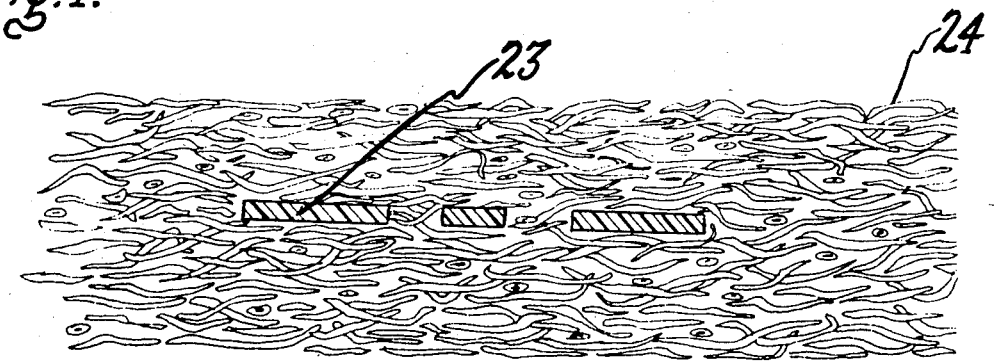
FIG. 7 is a sectional view of the finished paper with only indicia.

In FIG. 7 the strip material has completely dissolved and the individual fibers 24 have set the ink within a predetermined position within the slurry as determined by the original placement of the strip.

Figure 8:
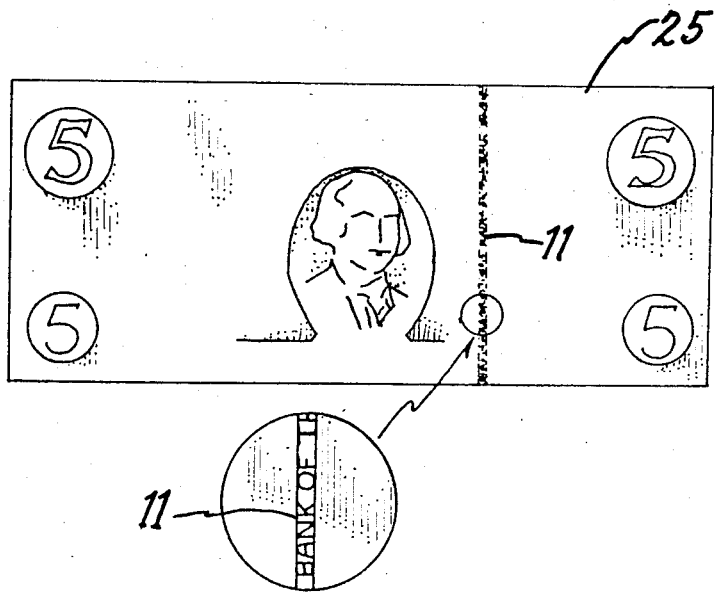
FIG. 8 is plan view of a currency bill containing the micro-code inserted therein by the soluble substrate strip according to the invention.

FIG. 8 shows a currency bill 25 manufactured containing the dissolving strip according to the invention and detailing the placement of the indicia 11 at a particular position as viewed by high-intensity transmitted light projected from the back surface.

In lieu of providing non-water soluble indicia to the strip surface as depicted in FIG. 1, an alternative method for providing authentication features within the paper involves the properties of the strip material itself.

Figure 9:
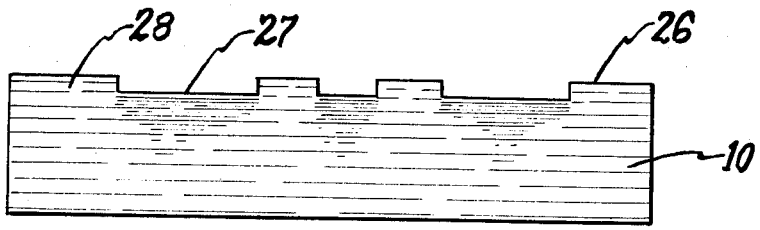
FIG. 9 is a an end view of a PVA strip with the micro-code impressed directly on the strip.

FIG. 9 depicts an end view of the strip 10 as viewed by means of polarized light within a pair of crossed polarizers. The information is impressed upon the surface of the strip 10 by an instrument similar to a typewriter with the ribbon removed. The bar code or symbols are pressed onto the surface of the strip to form an indentation 27 below the surface 26. When PVA material is used for the dissolving or "disappearing" strip 10 it was determined that the stress imposed upon the PVA material drastically changed its solubility characteristics. The polarized strain lines 28 which represent the densification of PVA material comprising strip 10 indicates that the material under the depression 27 is much denser than that under the un-stressed surface 26. When the water temperature is adjusted such that the un-stressed PVA material dissolves during the dewatering and drying stage the stressed PVA remains within the interstices of the paper fibers. The result is strikingly similar to a high quality water mark wherein the paper fibers are displaced from the region occupied by the undissolved PVA material and the indicia comprising the undissolved PVA material is readily readable by transmitted light. Other methods for selectively stressing the PVA material include treatment by ultraviolet light or high energy electrons wherein the material to be dissolved is masked. This is similar to the photoresist process used in making semi-conductor devices where acids are used to dissolve the undesired material. Besides its use as a means for authentification purposes, the impressment of indicia on the dissolving PVA strip 10 can also be used for other purposes for which watermarks are employed. The size of the watermark would determine the thickness as well as the width of the dissolving strip to be employed in the process.

Applicant has described herein methods and materials for imparting authentification indicia within paper during the paper making process such that the substrate for such indicia is dissolved in the process and is not removable from the paper material. Applicant has also described a method for providing high quality simulated watermarks having detailed features within the paper that are not otherwise attainable by standard wet screen watermark techniques.

I claim:

1. A method for providing security features or watermarks within paper comprising the steps of:

imparting indicia to the surface of a substrate material which is selectively dissolved at a predetermined temperature during the paper making process;

inserting the indicia bearing substrate within a water slurry containing paper fibers during dewatering of said water slurry and maintaining said slurry at a first temperature less than said predetermined temperature to incorporate said substrate within said paper fibers: while dewatering said slurry to consolidate said paper fibers into a wet paper sheet without dissolving said substrate; and dissolving said substrate at said predetermined temperature to incorporate said substrate within said paper sheet and to leave said indicia within said paper sheet without dissolving said paper fibers during drying of said wet paper sheet.

2. The method of claim 1 wherein said drying temperature is in excess of 100° F.

3. The method of claim 1 wherein said substrate material comprises a water soluble ester.

4. The method of claim 1 wherein said indicia comprises a non-water soluble material.

5. The method of claim 4 wherein said indicia material comprises fluorescent pigments and dyes, metallized and metal oxide films and printer's ink.

6. A method of imparting security information of watermarks within a paper comprising the steps of:

impressing indicia onto a surface of a substrate material which is water soluble at a first predetermined temperature to stress harden the material and to impart indicia at specific locations on said material and to selectively increase the temperature at which said stress-harden material dissolves up to a second predetermined temperature;

inserting said substrate within a water slurry containing paper fibers during a paper making process;

surrounding said substrate within said paper fibers;

dewatering said slurry to consolidate said paper fibers without dissolving said substrate; and heating said paper fibers to a drying temperature intermediate said first and second predetermined temperature to dry said paper fibers and to dissolve said substrate except for said specific locations.

7. A method for imparting security information or watermarks to paper comprising the steps of:

impressing indicia at a specific location on the surface of a substrate material;

treating said substrate material at said specific locations to render said specific locations less soluble than said substrate material at other locations;

inserting said substrate material within a slurry containing paper making fibers; and dewatering and heating said paper fibers to dissolve said substrate material except for said material which was treated thereby providing means for determining said specific locations within said paper by means of transmitted light.

8. A method for providing security features of watermarks to paper comprising the steps of:

providing indicia material on a substrate material being water soluble at a first predetermined temperature, said indicia material being non-soluble during dewatering and heating of paper fibers at said first predetermined temperature, said substrate material being non-soluble during said dewatering of said paper fibers; and heating said paper fibers to a drying temperature higher than said first predetermined temperature after said dewatering to dry said paper fibers and to dissolve said substrate material without dissolving said indicia material.

9. A method of providing security features of watermarks in paper comprising the steps of:

providing indicia material on the surface of a substrate material, both said indicia material and said substrate material being insoluble during dewatering and heating of paper fibers;

dewatering and heating said paper fibers to form a finished paper; and submitting said finished paper to a solvent material for dissolving said substrate material without dissolving said indicia material.

* * * * *